US010226680B2

(12) United States Patent
Simms

(10) Patent No.: US 10,226,680 B2
(45) Date of Patent: Mar. 12, 2019

(54) ATHLETIC TRAINING APPAREL AND SYSTEM

(71) Applicant: H-Bomb Productions LLC, Washington, DC (US)

(72) Inventor: Ronald Simms, Washington, DC (US)

(73) Assignee: H-Bomb Productions LLC, Washington, DC (US)

( * ) Notice: Subject to any disclaimer, the term of this patent is extended or adjusted under 35 U.S.C. 154(b) by 0 days.

(21) Appl. No.: 15/626,398

(22) Filed: Jun. 19, 2017

(65) Prior Publication Data

US 2017/0361189 A1 Dec. 21, 2017

Related U.S. Application Data

(60) Provisional application No. 62/351,511, filed on Jun. 17, 2016.

(51) Int. Cl.

| | |
|---|---|
| ***A63B 69/00*** | (2006.01) |
| ***A63B 69/26*** | (2006.01) |
| ***A63B 37/06*** | (2006.01) |
| ***A63B 43/00*** | (2006.01) |
| *A63B 22/00* | (2006.01) |

(52) U.S. Cl.

CPC ..... *A63B 69/004* (2013.01); *A63B 37/06* (2013.01); *A63B 43/005* (2013.01); *A63B 43/007* (2013.01); *A63B 69/26* (2013.01); *A41D 2600/10* (2013.01); *A63B 2022/0092* (2013.01); *A63B 2209/00* (2013.01); *A63B 2209/10* (2013.01)

(58) Field of Classification Search

CPC ..... A63B 43/005; A63B 67/00; A63B 67/002; A63B 2209/10; A63F 9/0208; A63F 2009/0239; A41D 13/0562

See application file for complete search history.

(56) References Cited

U.S. PATENT DOCUMENTS

| | | | | | |
|---|---|---|---|---|---|
| 3,927,881 | A | | 12/1975 | Lemelson | |
| 3,941,383 | A | | 3/1976 | Clarke | |
| 4,593,788 | A | * | 6/1986 | Miller | A61F 5/05883 128/869 |
| 4,971,334 | A | * | 11/1990 | Stewart | A63B 43/005 273/348.4 |
| 4,986,548 | A | * | 1/1991 | Conner | A63B 43/005 273/348.4 |
| 5,082,291 | A | * | 1/1992 | Appel | A63B 43/005 273/348.4 |
| 5,139,273 | A | * | 8/1992 | Rudell | A63B 43/005 273/348.4 |
| 5,221,092 | A | * | 6/1993 | Simons, Jr. | A63B 63/00 124/1 |
| D340,543 | S | * | 10/1993 | Ashton | D2/828 |
| 5,316,294 | A | | 5/1994 | Turangan | |
| D353,256 | S | | 12/1994 | VanZelf | |
| D365,194 | S | | 12/1995 | Vargo | |

(Continued)

*Primary Examiner* — Joshua Lee

(74) *Attorney, Agent, or Firm* — Millen White Zelano & Branigan

(57) ABSTRACT

A training system includes apparel and balls that fasten to the apparel. The apparel includes patches or strips of hook/loop fastener material that couples to strips of the hook/loop fastener material on the balls. The balls are removed during training by an opponent. The balls are placed on the apparel to emphasize training to that region.

8 Claims, 10 Drawing Sheets

(56) References Cited

U.S. PATENT DOCUMENTS

| | | | | |
|---|---|---|---|---|
| D375,581 | S | 11/1996 | Dyer | |
| 5,938,549 | A | 8/1999 | Schenkenfelder | |
| 6,353,932 | B2 | 3/2002 | Stembridge | |
| D460,786 | S | 7/2002 | Wilson | |
| 6,543,775 | B1 * | 4/2003 | Bell, Jr. | A63B 43/005 273/348.4 |
| D585,603 | S | 1/2009 | O'Connor | |
| D602,205 | S | 10/2009 | Thomas | |
| 2010/0001471 | A1 * | 1/2010 | Cho | A63B 63/003 273/348.4 |
| 2010/0323824 | A1 * | 12/2010 | Gamboa | A63B 69/00 473/438 |
| 2011/0307998 | A1 * | 12/2011 | Turner | A41D 13/05 2/455 |
| 2013/0000021 | A1 * | 1/2013 | Dolcetti | A63B 21/065 2/455 |
| 2016/0113339 | A1 * | 4/2016 | Dolcetti | A41D 31/0016 2/69 |

* cited by examiner

ATHLETIC TRAINING APPAREL AND SYSTEM

FIELD OF THE INVENTION

The present invention relates to apparel and a system worn to promote athletic training and conditioning.

BACKGROUND

Various types of impact sport games have been proposed over the years with some directed toward boxing. For example, U.S. Pat. No. 3,235,259 and U.S. Pat. No. 4,995,610 teach toy boxing games, where players control small toy boxing robots. Although the fighting toy boxer games may be fun, they do little to teach and enhance boxing skills and offer no remedial exercise value.

Video game versions of boxers have also been done over the years. See for example, U.S. 2005/0014542. Similar to toy boxers, the video games may be fun, they do little to teach and enhance boxing skills and offer no remedial exercise value. There have been numerous attempts at creating wearable clothing with sensors. See for example, U.S. Pat. No. 4,824,107.

Many active games utilize a material consisting of a first strip of a felt-like material having a plurality of exposed closed mini loops (loops) and a second strip having a plurality of hook-like mini hooks(hooks) adapted to engage and releasably retain the mini loops of the felt-like material. Such hook and loop material is commonly sold under the tradename VELCRO. For example, Impulse Ltd. marketed a VELCRO game set under the trademark STICKY FINGERS that contained baseballs, footballs, disks and corresponding gloves which were covered with hook and loop material to assist in catching the projectiles.

U.S. Pat. No. 4,995,617 discloses a similar VELCRO game set which includes a disk and a corresponding glove that are covered with hook and loop material. U.S. Pat. No. 5,195,745 discloses a football and glove game set which have corresponding hook and loop material that is used to grasp the football. U.S. Pat. No. 4,718,677 discloses a throw and catch game that includes VELCRO covered elbow and knee pads that are used to catch a VELCRO covered ball. U.S. Pat. No. 4,735,420 discloses a VELCRO covered paddle that is used to catch a VELCRO covered ball. U.S. Pat. No. 4,244,576 discloses a miniature golf game that includes a VELCRO covered ball that is shot at a green that is almost entirely covered with VELCRO attaching material.

Games of flag tag, and games of the like, are well-known in the prior art. Typically, a game of flag tag is played between two or more players, each player being provided with a flag to show their participation in the game. Each player attempts to gather the flag of an opposing player, or of all players of an opposing team. Game play continues until one player, or one team of players, collects all the flags of all other players, or of all players of all opposing teams. Variations in games of tag, and in apparatuses used therein, are well-known. For example, U.S. Pat. No. 3,063,718 teaches a detachable streamer means for use in playing touch football.

The present invention teaches participants stamina, footwork and situational awareness skills in a safe and fun manner. The present invention teaches participants the skills/moves needed to protect their torso and the skills to properly engage the torso of other player/participants in a safe and fun manner.

SUMMARY OF THE INVENTION

For purposes of convenience and illustration, one of skill in the art will appreciate that the methods, systems, and apparatus disclosed herein are broadly applicable, for example to various martial arts disciplines, fitness regimes, sports and/or the like. It should be understood throughout that the hook/loop fastener attached to the apparel fabric is complimentary to the hook/loop fastener material used on the ball.

The human body core, its positioning, and its motion are very important for many athletic activities. The body core is a center point of rotation and power generation. Moreover, in boxing and martial arts being able to repeatedly place the body in the proper posture and correctly position the body at the beginning of and over the course of the event are critical to developing consistent situational body awareness. Thus, an object of the present invention is to provide a wearable torso training device for training athletes and in particular boxers and martial arts athletes. The device can be worn by opposing players e.g., a boxing game and/or for training. It allows the players to develop stamina, footwork and situational awareness skills in a safe and fun manner. The disclosed embodiments include training gear such as a training shirt having strips or patches with hook/loop fasteners such as, for example, VELCRO. The hook and/or loop fastener is sewn to the outside face of the front portion of the apparel in a zone area. The strips or patches may hold balls or other grabable items which also use the hook and/or loop fasteners. The opponents using the gear try to grab the balls from the apparel using moves that simulate other sports, such as boxing. Upon grabbing a ball from the opponent's apparel, a user may be granted a point. Using such a system, games may be played to develop skills and conditioning. The disclosed embodiments may enhance cardiovascular fitness, eye/hand coordination, defensive combatant skills, lower body agility, situational awareness, quickness, and the like. Additionally, the game played with the apparel of the present invention provides a non-injurious alternative contact sport for all ages and body types. The training gear, or system, may be comprised of the disclosed apparel and the balls. More particularly, the training gear may include apparel having strips or patches of hook and/or loop fasteners. The balls preferably are plastic wiffle balls, lightweight foam balls or soft elastic balls. More particularly, the balls used with the apparel are plastic golf ball-sized wiffle balls or foam balls. The balls have hook and/or fastener strips on them as well to attach to the surfaces on the apparel. The hook/loop fastener (e.g., VELCRO) attached to the apparel fabric is complimentary to the hook/loop fastener material used on the ball. Preferably, the apparel used in the disclosed embodiments is athletic shirts. More particularly, dri-fit shirts are used. During training or game play, each participant attempts to pull the balls from the apparel of the opposing participant (s) while protecting the balls attached to their apparel.

BRIEF DESCRIPTION OF THE DRAWINGS

Various other features and attendant advantages of the present invention will be more fully appreciated when considered in conjunction with the accompanying drawings.

DETAILED DESCRIPTION OF THE PREFERRED EMBODIMENTS

Reference will now be made in detail to specific embodiments of the present invention. Examples of these embodiments are illustrated in the accompanying drawings. Numerous specific details are set forth in order to provide a thorough understanding of the present invention. While the embodiments will be described in conjunction with the drawings, it will be understood that the following description is not intended to limit the present invention to any one embodiment. On the contrary, the following description is intended to cover alternatives, modifications, and equivalents as may be included within the spirit and scope of the appended claims. Numerous specific details are set forth in order to provide a thorough understanding of the present invention. It should be understood throughout that the hook and/or loop fastener attached to the apparel fabric is complimentary to the hook and/or loop fastener material used on the ball. Thus, hook fastener can be attached to either apparel or balls and loop fastener can be attached to either apparel or balls.

Figure 1:
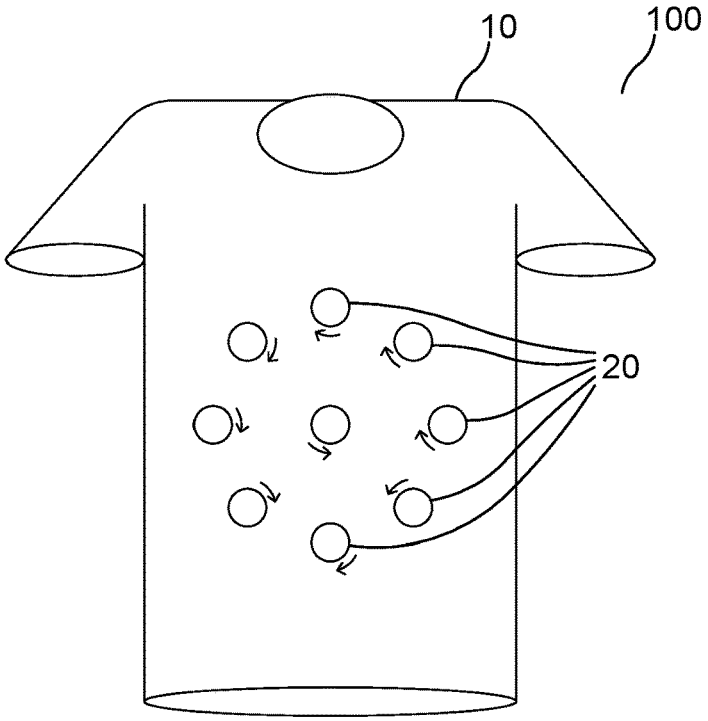
FIG. 1 illustrates a training system according to the disclosed embodiments.

FIG. 1 depicts training system 100 according to the disclosed embodiments. System 100 includes apparel 10. As shown, apparel 10 is a shirt. More preferably, apparel 10 is a lightweight fitted shirt. A more fitted shirt is preferred as an oversized or overly loose garment may result in the fabric bunching around hook/loop fastener sticking areas. Apparel 10, however, may be any item of clothing worn. A shirt is preferred do to the ease of training for boxing or other sports. Further, the area for grabbing the attached balls is safer than other areas on the body. If, however, one wants to emphasize access to a specified area of the body, such as a shoulder, then those locations may be used.

System 100 includes a plurality of fabric patches 20 located on apparel 10. Fabric patches preferably are comprised of hook and fastener fabric. As shown, there are 9 fabric patches on apparel 10. A circular design is shown with a center fabric patch 20. Any design of fabric patches may be used. Preferably, fabric patches 20 have a diameter of between 0.5 includes and 3 inches. Fabric patches 20 have space between them so as to not catch balls on the patches that are located elsewhere. In other words, fabric patches 20 should not interfere with balls 30 when they are on apparel 10.

Figure 2:
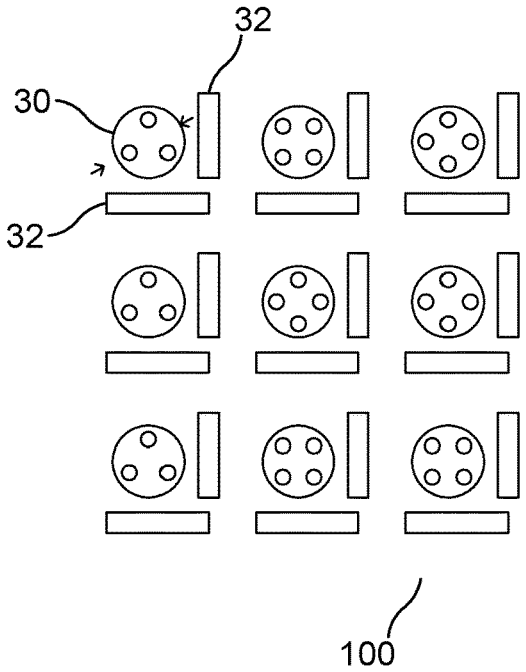
FIG. 2 illustrates balls for use in the system according to the disclosed embodiments.

FIG. 2 depicts balls 30 for use in system 100 according to the disclosed embodiments. Balls 30 attach to fabric patches 20 on apparel 10. Balls 30 include hook and fastener strips 32. As noted above, balls 30 are preferably golf ball-sized wiffle balls made of plastic or lightweight foam balls. This way, balls 30 are lightweight and durable for use during sparring or training. Fastener strips 32 encircle or attach to balls 30, usually overlapping each other. More preferably, fastener strips 32 have dimensions of about 5.5. inches by 0.5 inches, though other dimensions may be used.

Figure 3:
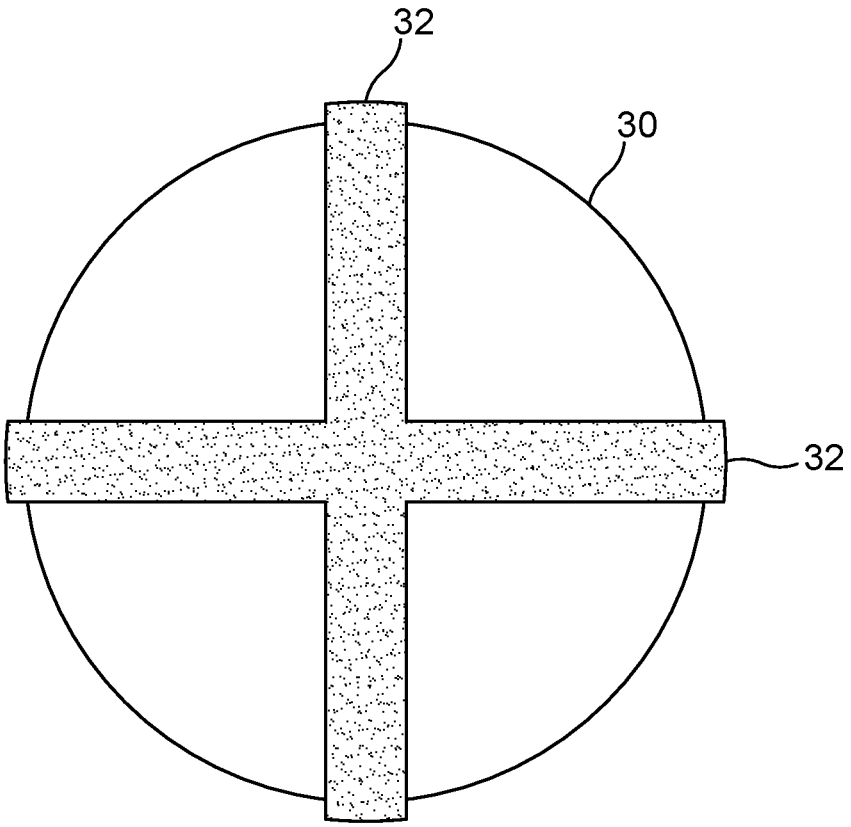
FIG. 3 illustrates a ball having fastener strips according to the disclosed embodiments.

FIG. 3 depicts a ball. 30 having fastener strips 32 according to the disclosed embodiments. As shown, ball 30 is a lightweight plastic wiffle ball, with a size of about that of a golf ball. Fastener strips 32 may encase or encompass ball 30 as shown. Preferably, fastener strips 32 are intersect on opposite sides of ball 30. This configuration allows for each surface of ball 30 to be connectable to a fabric patch 20.

Figure 4:
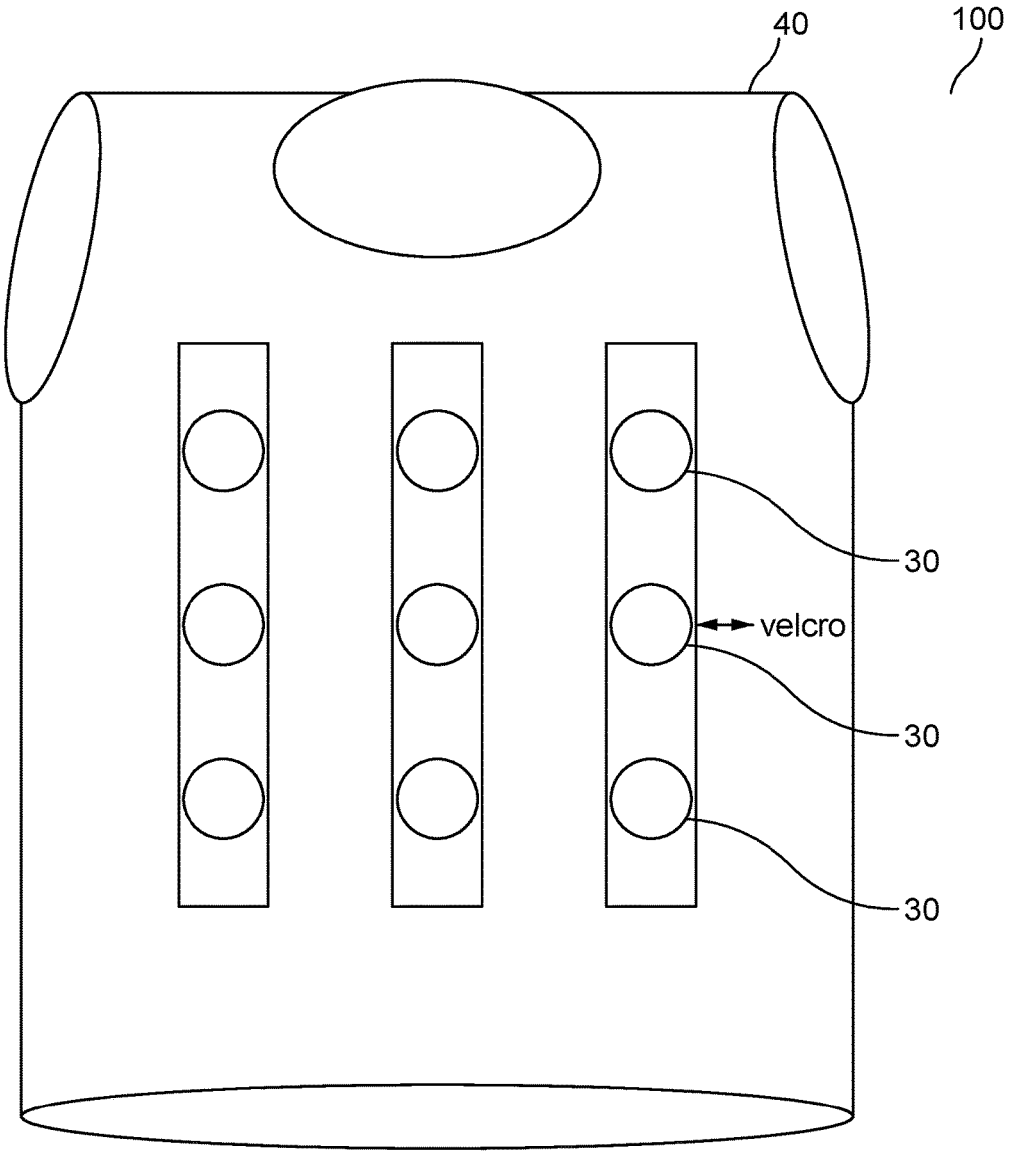
FIG. 4 illustrates another embodiment of the training system according to the disclosed embodiments.
Figure 5:
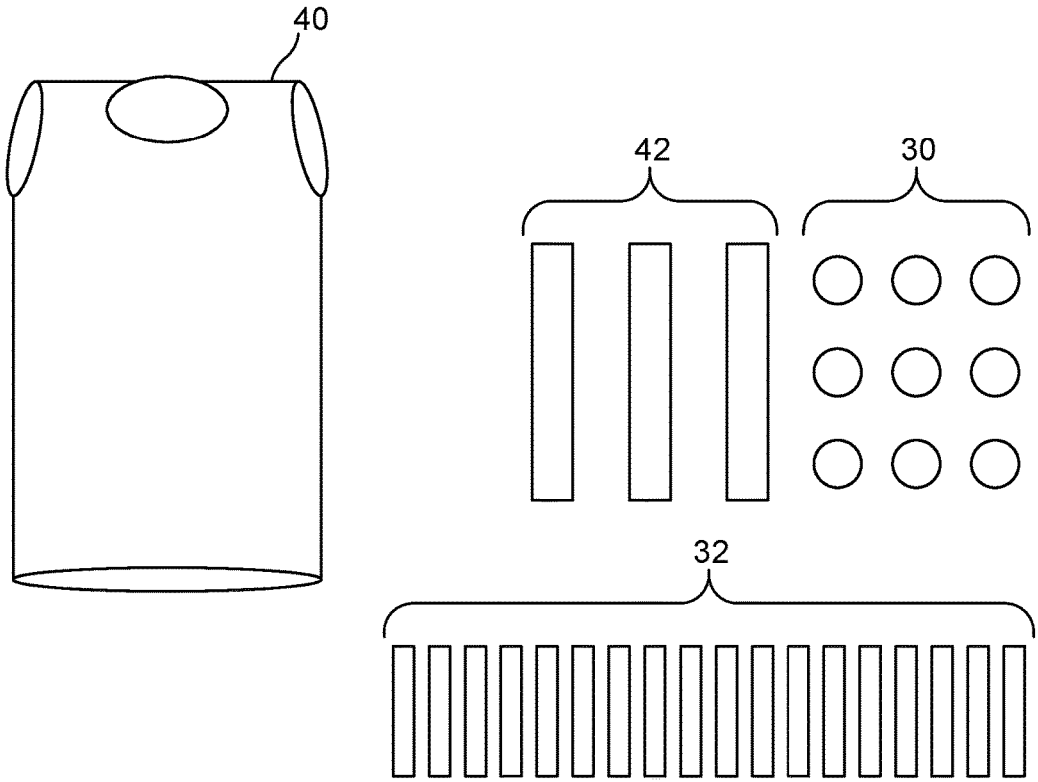
FIG. 5 illustrates the training system as broken down to individual pieces.
Figure 6:
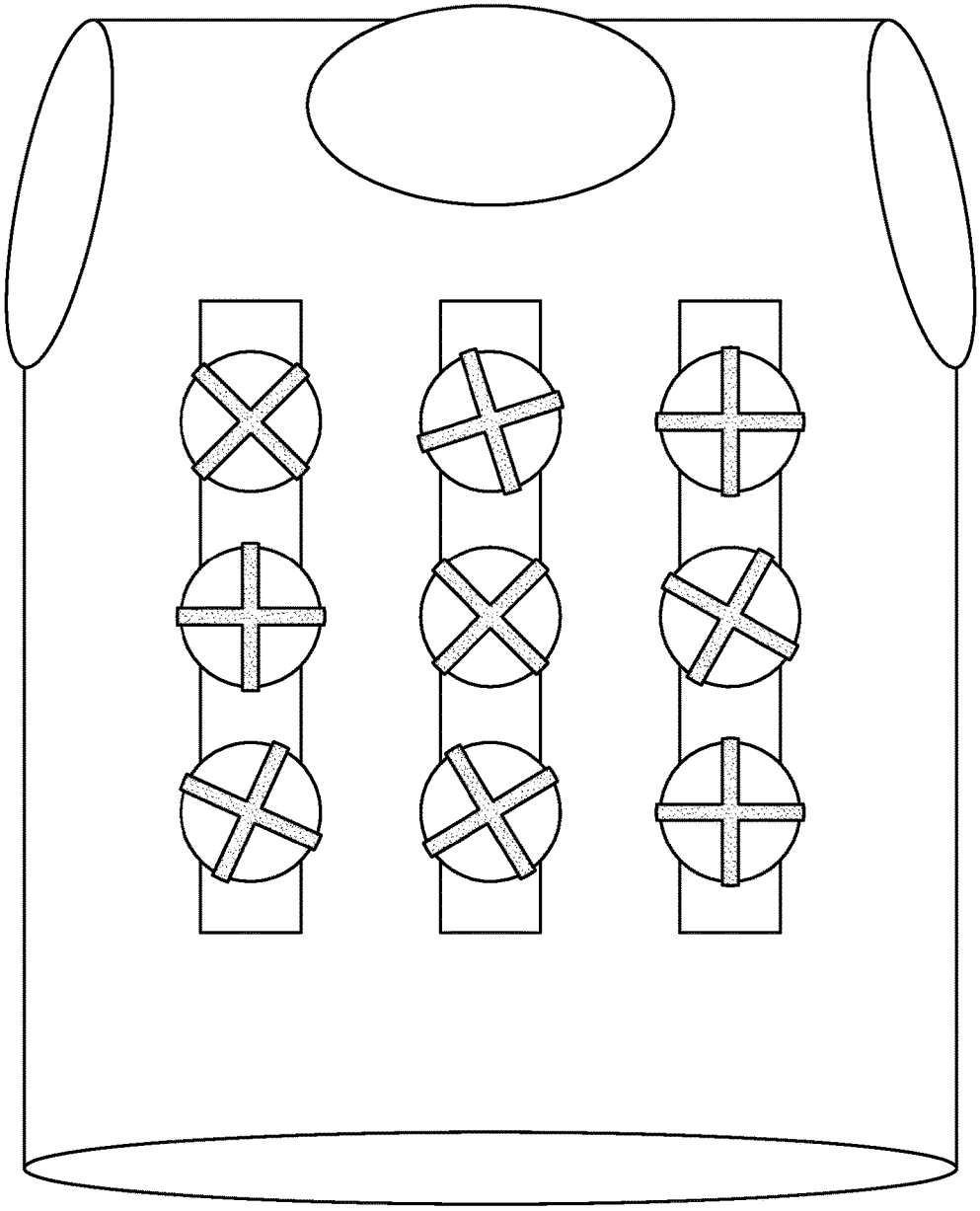
FIG. 6 illustrates the training system assembled according to the disclosed embodiments.
Figure 7:
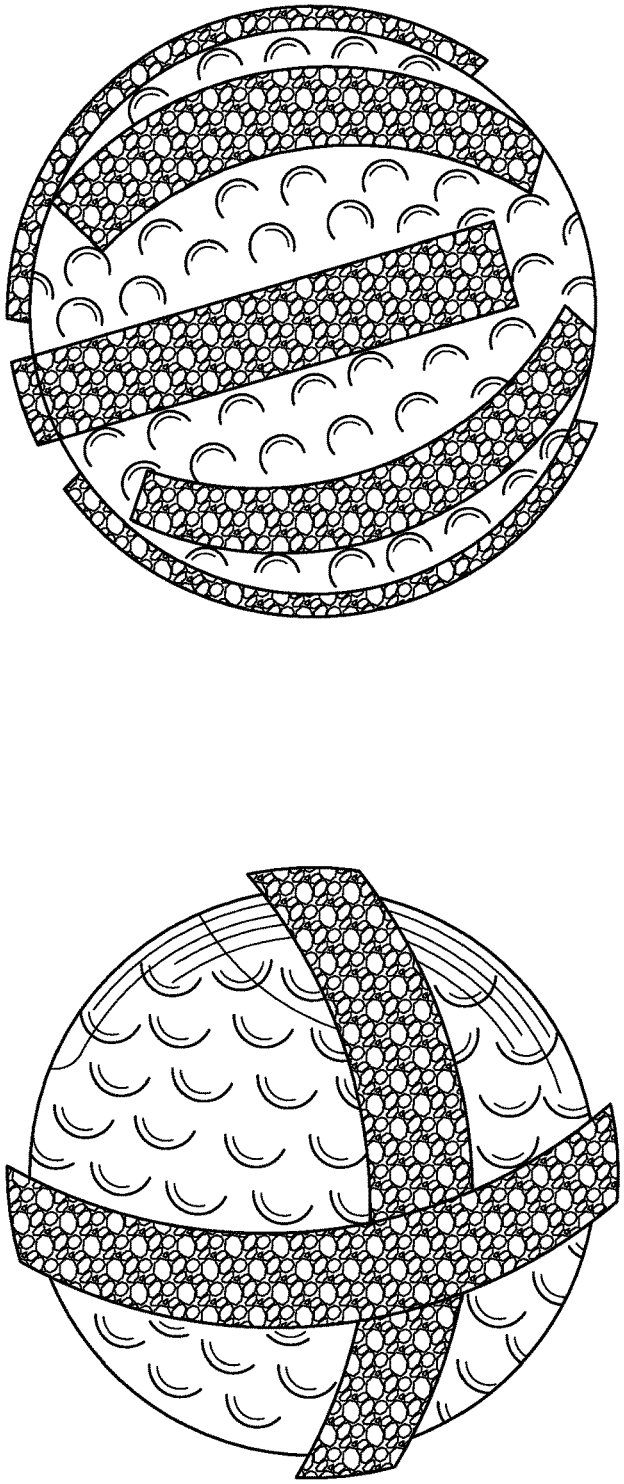
FIG. 7 depicts two ball embodiments in which the balls are covered in different hook/loop fastener material configurations.
Figure 10:
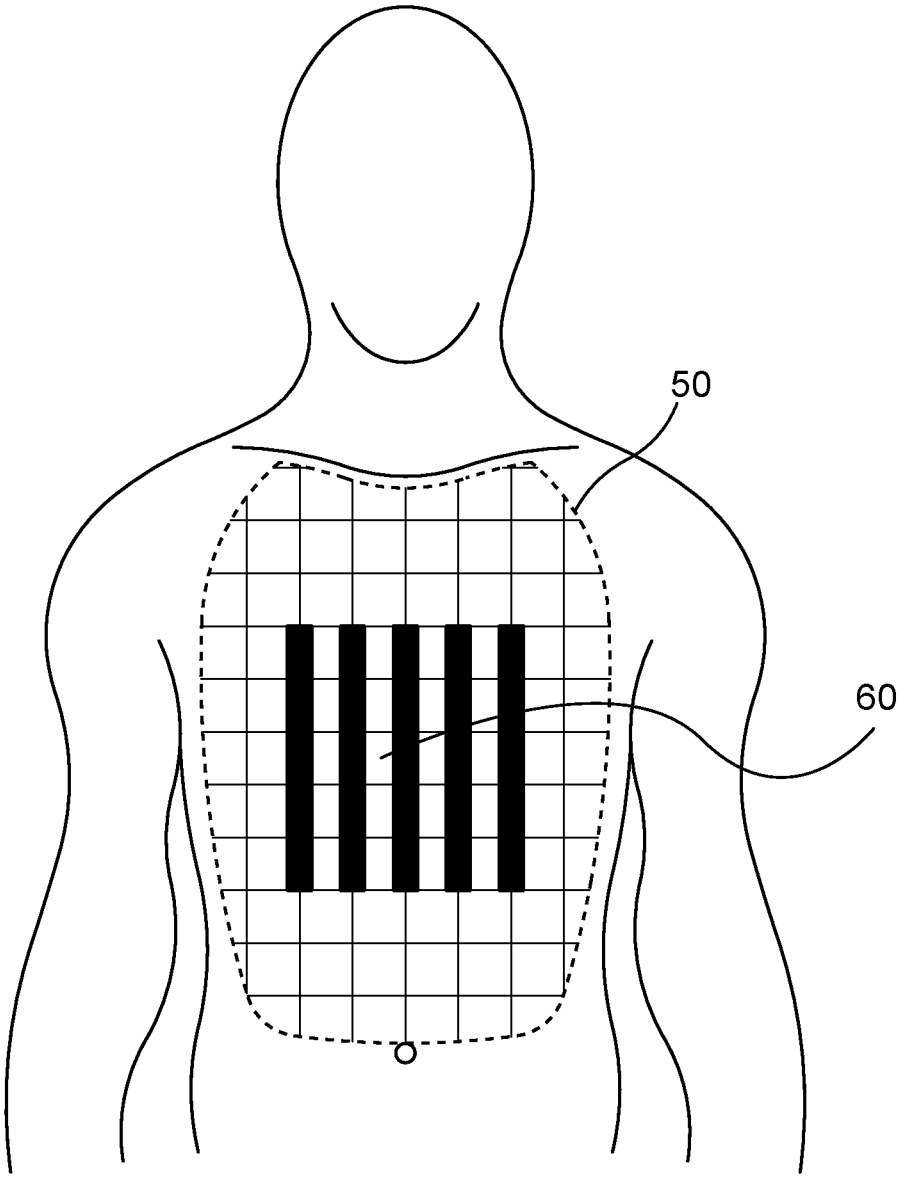
FIG. 10 depicts a zone area within a target area. The zone area is created by vertical hook/loop strips.

FIG. 4 depicts another embodiment of system 100 according to the disclosed embodiments. System 100 in this instance includes apparel 40 and balls 30. Apparel 40 may be a shirt as well, but this time without any sleeves. Apparel 40 also may be a vest worn overtops a shirt or other clothing item. System 100 includes fastener strips 42 instead of fabric patches 20. Fastener strips 42 may have dimensions of 15 inches by 2.5 inches. Fastener strips 42 may be parallel strips of hook and fastener fabric. Preferably, fastener strips 40 may be arranged in the vertical direction, though they may be arranged horizontally or diagonally. FIG. 10 depicts an embodiment with the hook/loop fastener strips arranged in a vertical direction. Balls 30 attach to strips 42. This system 100 allows for dynamic placement of balls 30 to emphasize those locations during training. FIG. 5 depicts system 100 as broken down to individual pieces. As shown, nine balls 30 may be attached to three fastener strips 42 using eighteen fastener strips 32. FIG. 6 depicts system 100 assembled according to the disclosed embodiments.

Figure 8:
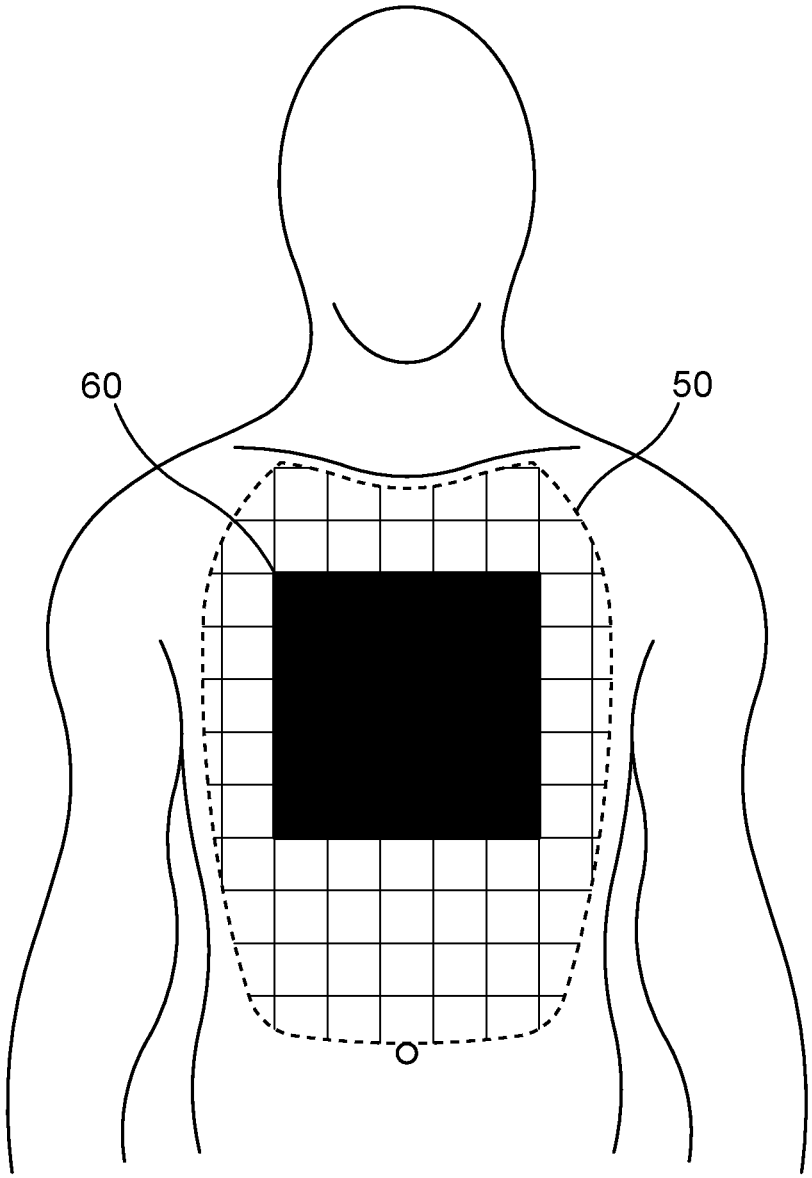
FIG. 8 depicts a zone area within a target area. The zone area is created by a single patch of hook/loop fastener material.
Figure 9:
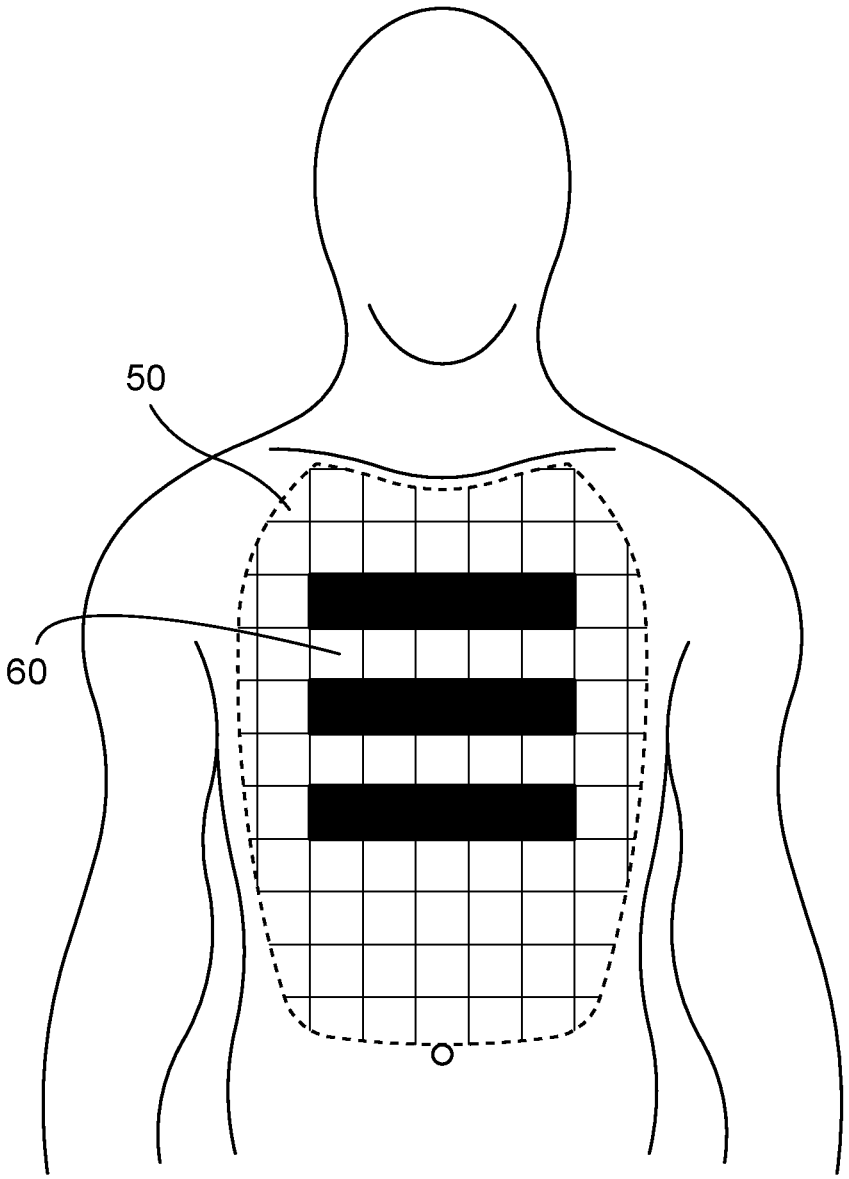
FIG. 9 depicts a zone area within a target area. The zone area is created by three horizontal hook/loop strips.

FIGS. 8-10 depict another embodiment of the present invention. The apparel zone area (60) is at least partly covered with a hook and/or loop type material comprising a plurality of hooks; and a plurality of balls each at least partly covered with a material adapted to engage with the hooked material on the zone area (60). Alternatively, the zone area (60) may contain the loop material and the balls may contain the hooked material. The hook/loop material attached to the apparel fabric is complimentary to the hook/loop material attached to the ball.

Preferably, ball (30) is made of a hollow hard plastic ball (e.g., wiffle ball) or lightweight polyurethane foam ball. The approximate size of the diameter of the hook/loop covered ball is about 1.5 to 2.5 inches In short, all of these dimensions can vary depending on the size of the game players and the competitive nature of the game. In general the ball (30) is between 1.4 to 2.1 inches in diameter. Most preferably, the ball is between 1.5 to 2 inches in diameter. In a most preferred embodiment, the ball is between 1.6 and 1.8 inches in diameter. A typical golf ball is 1.68-inches (42.7 mm) in diameter. The hook/loop material attachment pieces will add about a tenth of an inch in thickness to the overall ball diameter of the portion of the ball where the hook/loop material is applied. In general, any ball size which is easy to grip is contemplated. Thus, a child size hand may be more suited to a smaller ball size and an adult size hand may be more suited to a large size ball. Generally, a ball of a size that is able to fit into the palm of one's hand or easily grasped by the hand is contemplated.

Numerous manners of affixing the hook/loop fastener (e.g. VELCRO) to the balls are contemplated. In certain ball embodiments a central through groove may be molded into the ball to receive hook/loop material strips or bands around the circumference of the balls. In other embodiments the desired number of hook/loop material (e.g., VELCRO) strips are glued around the circumference of the ball. Preferably, the strips are glued to the surface of the ball. For this purpose, any good fabric cement can be used, e.g., rubber and synthetic rubber cements are satisfactory. In certain embodiments the entire ball may be covered in hook/loop material (e.g., VELCRO) such as, for example, shown in U.S. Pat. No. 3,927,881 to Lemelson.

The target area (50) is located within the area of the front torso covering the ribs on the front portion between the arms and extending horizontally between the collarbone and the navel. See, for example, FIGS. 8, 9, 10. The target area (50) represents areas of vulnerability inherent in the human form. In a preferred embodiment the hook and loop fasteners are in the form of strips applied to the apparel and placed in either horizontal rows or vertical rows. Depending on the width of the strips, typically three to six strips are spaced to create a target zone (60) within the target area (50) which covers the desired portion of the front torso. Thus, the outer edges of the outer strips create the boundaries of the zone. Alternatively, the hook and loop fasteners are in the form of patches or dots applied to the apparel and placed in a pattern. Depending on the size of the patches, typically six to eleven patches are spaced to create a target zone pattern which covers the desired portion of the torso target area (50). Thus, the outer edges of the outer patches or the outer edges of the outer strips create the boundaries of the zone area (60). For example, the zone area (60) in FIGS. 8 and 9 would be about the same. In certain embodiments, such as shown in FIG. 8, the entire zone area (60) is covered with a single piece of hook and/or loop fastener. Preferably the zone area (60) covers from 18-90% of the target area (e.g., 20, 25, 35, 45, 55, 65, 75, and 85%). In a preferred embodiment the zone area (60) covers from 20-65% of the target area (50). In certain embodiments the zone area (60) covers from 25-60% of the target area (50).

Each player wears apparel with a zone area (60) and a desired number of game balls attached to the hook/loop strips and/or patches arranged in the zone area (60). In one game, the players try to protect the balls attached to their apparel while capturing the balls attached on the zone area of other players apparel. Since the target area (50) and thus the zone area (60) is not on the extremities, the player's arms and legs may be used purely for shielding and dodging purposes. Typically, a game of tag is played between two or more players, each player being provided apparel with a zone area (60) and a desired number of game balls attached to the Velcro strips and/or patches arranged in the zone area. Each player attempts to capture the balls of an opposing player, or of all players of an opposing team. Game play continues until one player, or one team of players, collects all the balls of all other players, or of all players of all opposing teams. Alternatively, a player can be knocked out when all of their balls are captured and game play continues until only one player is left with balls attached to their zone area.

Figure 11A:
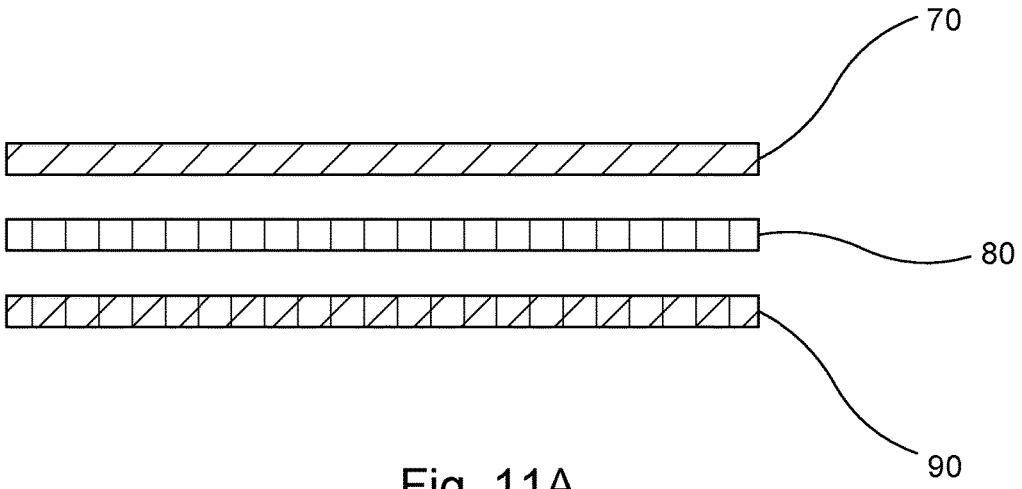
FIG. 11*a* depicts an arrangement of a stiffener sheet located between the hook/loop fastener and fabric layer.
Figure 11B:
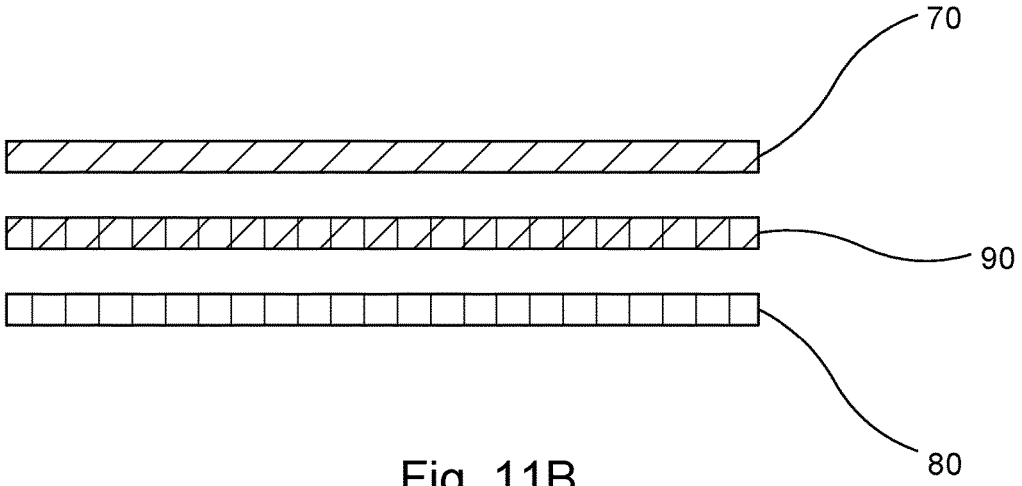
FIG. 11*b* depicts an arrangement of hook/loop fastener, fabric and stiffener sheet.

If the hook/loop fastener strips are not sufficiently rigid the shirt has a tendency to fold upon itself as a player bends over causing the hook/loop strips to catch on other portions of the apparel or on the exposed hook/loop of the balls. This distorts the target surface areas of the apparel as the fabric and fastener becomes "bunched up". This is undesirable as game play must be stopped to allow the apparel to be un-bunched. Thus, it is desirable that the zone area (60) of a sufficient stiffness to prevent the apparel front from bending during play so as to avoid bunching up. If the hook/loop fastener itself is not of a sufficient rigidity the zone area (60) may be reinforced with an additional material to build rigidity or stiffness into the target area. The zone area (60) must be of sufficient stiffness that during play the apparel does not catch the exposed hook/loop of the balls and bunch up. In one embodiment, a non-woven fabric stiffener material sheet is employed under the hook and/or loop fastener so that the apparel will resist "bunching up" while in use. The stiffener sheet is characterized by a resilient characteristic tending to maintain it in a flat condition, thereby minimizing the tendency of the apparel to bunch. The stiffener sheet (80) is further characterized by having sufficient flexibility to allow the apparel to move with the athlete in a natural manner. The stiffener material may be a backsheet located on the inside of the apparel next to the skin or may be located directly under the hook and/or look fastener strips and or patches. FIG. 11*a* depicts an arrangement of hook/loop fastener (42), stiffener sheet (80) and fabric (90). FIG. 11*b* depicts an arrangement of hook/loop fastener (42), fabric (90) and stiffener sheet (80).

The degree of stiffness of the sheet is readily determinable from the following teachings.

The function of the stiffener sheet (80) is to prevent, or minimize the tendency of the apparel from "bunching up" when in use. As above noted, apparel has a tendency to move when a player bends over, twists or shifts his/her position during play. The stiffener sheet (80) serves the function of maintaining the zone area (60) in an un-bunched condition when in use.

In most embodiments the stiffener sheet (80) is, however, by no means rigid. Nonetheless, the stiffener sheet (80) possesses sufficient stiffness, and/or resilience, for it to maintain the apparel in an un-bunched condition during play and resist the tendency of the apparel to shift and fold upon itself to a "bunched up" condition.

Other considerations in the selection of the non-woven fabric of the stiffener sheet are weight, flexibility and washability. Desirably, the woven or non-woven sheet should be light weight, an end which is usually attained by employing a relatively thin woven or non-woven fabric. Fabric breathability is also desirable. Thus, suitable stiffener sheet material includes, for example, non-woven fleece or felt interfacing such as, for example, the interfacing sold by C&T TIMTEX OR PELLON #65 EXTRA-HEAVY, PELLON #806, PELLON #50, PELLON #926.

The stiffener sheet (80) also requires flexibility to prevent its being fractured during use and washing, as well as in the manufacturing process, as when being stitched.

The washability requirement is obvious from the stated purpose of the present invention to provide an improved, reusable hygienic product, which, inherently, requires washing.

It has been found that, a stiffener sheet (80) comprising 100% polyester fibers, or staples, needle punched and heat set, with a thickness of approximately 3/63 inch and a weight of 4 ounces per square yard has been found satisfactory. Such non-woven fabrics are available from a number of commercial sources. A stiffener sheet (80) with a weight between about 2.5-6 ounces per square yard is preferred. A stiffener sheet (80) with a thickness of about between $1/30^{th}$ to $4/30^{ths}$ of an inch is preferred.

The "bunching" problem may also minimized by further stiffening through thicker hook/loop strips.

The apparel may be made from one or more fabric elements in a conventional manner, from conventional materials, and/or of conventional constructions. Any number of desired individual fabric elements or pieces may be engaged together via sewing or in another desired manner without departing from this invention. In some examples, the garment structure may be made at least in part from an elastomeric material, such as a spandex material, or other material that provides a tight, close fit over the body or at least over a portion of the body where the target zone is to be located. In a preferred embodiment the base fabric may be a DRI-FIT® fabric material of the type commercially available from NIKE, Inc. of Beaverton, Oreg. If desired, all or some portions of the base fabric may be made from a mesh material or other breathable material to provide a cool and comfortable fit.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

We claim:

1. The game of tag comprising at least two players each of which wear a training system comprising an item of apparel having a hook/loop fastener piece or pieces arranged in a target zone area; and a plurality of balls having hook/loop fastener strips, wherein the hook/loop fastener strips couple to the apparel hook/loop fastener piece or pieces, wherein each player has a plurality of balls attached to the target zone area of their item of apparel via the hook/loop fastener piece or pieces and wherein each player tries to capture the ball(s) from the target zone area of the other player while protecting the balls attached to their target zone area.

2. The game of tag according to claim 1, wherein game play continues until one player collects all the balls of all other players.

3. The game of tag according to claim 1, wherein game play continues until one team of players, collects all the balls of all players of all opposing teams.

4. The game of tag according to claim 1, wherein a player is knocked out when all of their balls are captured and game play continues until only one player is left with balls attached to their target zone area.

5. The game of tag according to claim 1, wherein said players use their arms for shielding their target zone area and for grabbing opposing players' balls.

6. The game of tag according to claim 1, wherein a stiffener sheet (80) is adjacent to an inner surface of said item of apparel.

7. The game of tag according to claim 1, wherein said target zone area (60) covers between 18-90% of a target area (50).

8. The game of tag according to claim 7, wherein said target zone area (60) covers between 20-65% of a target area (50).

* * * * *